US006164359A

United States Patent [19]

Guardiola

[11] Patent Number: 6,164,359

[45] Date of Patent: Dec. 26, 2000

[54] FOR AN AUTOMATIC LABELING MACHINE FOR PACKERS IN BAGS OF MESH OR THE LIKE

[75] Inventor: Agustin Dauder Guardiola, Badalona, Spain

[73] Assignee: Talleres Daumar, S.A., Barcelona, Spain

[21] Appl. No.: 09/102,288

[22] Filed: Jun. 22, 1998

[30] Foreign Application Priority Data

Jun. 23, 1997 [ES] Spain ..... P 9701375

[51] Int. Cl.[7] ..... B65C 9/00

[52] U.S. Cl. ..... 156/542; 156/541; 156/566; 156/DIG. 31

[58] Field of Search ..... 156/542, 566, 156/DIG. 31, 541, 556, DIG. 28

[56] References Cited

U.S. PATENT DOCUMENTS

| | | | |
|---|---|---|---|
| 4,347,094 | 8/1982 | Watanabe | 156/387 |
| 4,629,528 | 12/1986 | Tanaka et al. | 156/351 |
| 4,954,203 | 9/1990 | Matsumoto | 156/361 |
| 5,294,283 | 3/1994 | Guardiola | 156/566 |
| 5,300,181 | 4/1994 | Yamaguchi | 156/542 |

FOREIGN PATENT DOCUMENTS

| | | |
|---|---|---|
| 399558 | 1/1972 | Spain . |
| 408111 | 10/1972 | Spain . |

*Primary Examiner*—Richard Crispino
*Assistant Examiner*—Sue A. Purvis
*Attorney, Agent, or Firm*—Lackenbach Siegel

[57] ABSTRACT

Improvements in the object of the U.S. Pat. No. 5,294,283 for an automatic labelling machine for packers in bags of mesh or the like, which have: a second roller (101) with its counter roller (102), some independent means of activation (120), (121), and (123) of the means of cutting (16), of the cart (18), and of the finger (27) with claws (28); the printer head (10) and the counter roller (102) both being mounted on elastic laminar supports (112) and (104), with keying in their respective operating position; and mechanical linkage of turning (127) and (128) of the second roller (101) and of the roller (6).

1 Claim, 5 Drawing Sheets

FOR AN AUTOMATIC LABELING MACHINE FOR PACKERS IN BAGS OF MESH OR THE LIKE

FIELD OF THE INVENTION

The entity petitioning the present invention has developed some improvements on the object of the U.S. Pat. No. 5,294,283 which has as its object an automatic labelling machine for packers in mesh bags or the like, which improvements have been obtained from and are the result of his experience in this industrial field, and in particular, in the tests and analysis corresponding to putting into practice and execution of the labelling machine which is the object of U.S. Pat. No. 5,294,283

BACKGROUND OF THE INVENTION

In the U.S. Pat. No. 5,294,283 there are described the characteristics of labelling machines already known and the object of the Spanish patents No. 399,558, No. 408.111, and No. 554,613.

The automatic labelling machine for packers in mesh bags or the like which is the object of the U.S. Pat. No. 5,294,283 is of the type which includes a bobbin joined to a frame and feeder of a continuous strip of labels, where applicable linked by more narrow appendages, some means of guiding said strip, some means of cutting to separate the labels from the strip and some means of regulating and control, and including also some [means] of activating the strip which has a nonslipping surface roller, transverse with respect to the guiding means of the strip of labels and in which said strip is supported for its being pulled toward the outlet of the machine, turning said roller by means of some motors and through corresponding means of transmission, having a printer head, preferably by selective heat in predetermined and programmable points, which is applied against the corresponding face, preferably heat sensitive, of the strip of labels by elastic means and in the zone in which the surface opposite said tape is supported on the cited turning roller, for which purpose the head is articulated along a longitudinal axis mounted on a transverse shaft joined to the frame, and with the possibility of a means for separating voluntarily from the head with respect to the strip.

Said automatic labelling machine is characterized in that it has a cart which moves back and forth as a result of means of activation along one supporting plate projected downward and fixed to the frame, which plate has guiding means for displacement of the last label from the strip and a central channel, longitudinal and with a conforming transverse profile, preferably terraced toward the inside, which is extended forming an appendage downward equipped also with said conforming profile; such that both sides of the cart are traversed by a shaft to which are fixed connecting rod tracks which are tilting and backed up, respectively and outside, at each one of said side parts, one end of the shaft projecting with respect to one of said connecting rods defining a projection, advantageously equipped with a sleeve affixed to the same, while the other end of the shaft projects from the other connecting rod and has connected to it a cam; such that the free ends of the two connecting rods are rigidly connected by a tie rod, in which intermediate part is fixed a finger equipped with at least one claw able to confront the conforming profile and introduce itself in the same with intercalation of the corresponding part of the label already cut from the strip, for pulling it to the outlet of the machine; such that the means of activating the cart are articulated to the tie rod on which the finger is fixed; such that it has a retaining lever articulated to the frame and equipped with lateral notch into which is introduced the projection of the shaft for turning the connecting rod, when the cart is in its closest position to the cutting means, and said lever being pushed against said projection by some elastic means; such that the retaining lever presents its free end along an interior inclined plane, against which slides the projection during part of the back and forth runs of the cart, and the connecting rod of the projection has a stop situated in an advanced position with respect to the projection which when the cart goes forward (toward the outlet of the machine) it is displacing outward the retaining lever, releasing the projection from the notch of the latter; and such that during the advance of the cart, the cam of the turning shaft of the connecting rods activates cutting means for the separation of the corresponding end label from the strip of the same, through corresponding transmission means.

The labelling machine according to the U.S. Pat. No. 5,294,283 affords a series of advantages with respect to the labelling machines already known, which are described in it, aside from those which are deduced from the example of implementation which is described and illustrated therein.

SUMMARY OF THE INVENTION

The improvements which are the object of the present invention are characterized by a second roller with its corresponding counter roller, both having a non-slip surface, situated upstream—in relation to the direction of displacement of the label strip—with respect to the roller facing the printer head and parallel to the same, between which roller and its counter roller is drawn the label strip together with the roller situated downstream; by each means of independent activation for the cutting means, the displacement of the cart and the turning of the figure with claws; for the printer head and the counter roller both being mounted in laminar and elastic supports and having some respective means which can be activated manually for separating them independently with respect to the strip of labels, with keying in their respective operating position; and for both rollers being connected mechanically in turning, the motor means activating one of them through corresponding means of transmission.

The improvements which are the object of the present invention afford, among other things, the following advantages: they permit a greater force of traction of the second roller over the label strip, able to apply a relatively high tension on the part of its counter roller, which ensures the pulling and transport of the strip of labels even when its surface has slippery printing. The roller confronting the printer head can only apply a lower tension to the latter, by the limitation which is imposed for its correct operation; adjustments are facilitated of the machine and its synchronization of its operating phases; they ensure the maintenance of the tensions applied by the counter roller of the second roller and by the roller facing the printer head, preventing errors in the operational positioning of both on the part of the user and facilitating such positioning; they permit a great separation—when they are in the non-operating position—of the printer head and of the counter roller with respect to the strip of labels, facilitating access of the user to perform various operations, such as adjustment and maintenance; and provide the synchronized turning movement of the two rollers.

The improvements in the automatic labelling machine which are the object of the U.S. Pat. No. 5,294,283 and in accordance with the present invention offer the advantages which have been described previously, besides others which will be inferred easily from the example of implementation of said labelling machine equipped with such improvements, which is described in greater detail hereafter to facilitate the comprehension of the characteristics explained and explaining at the same time various details, being accompanied for this purpose by some drawings in which, a practical case of the same is represented.

DESCRIPTION OF AN IMPLEMENTATION ACCORDING TO THE INVENTION

Figure 1:
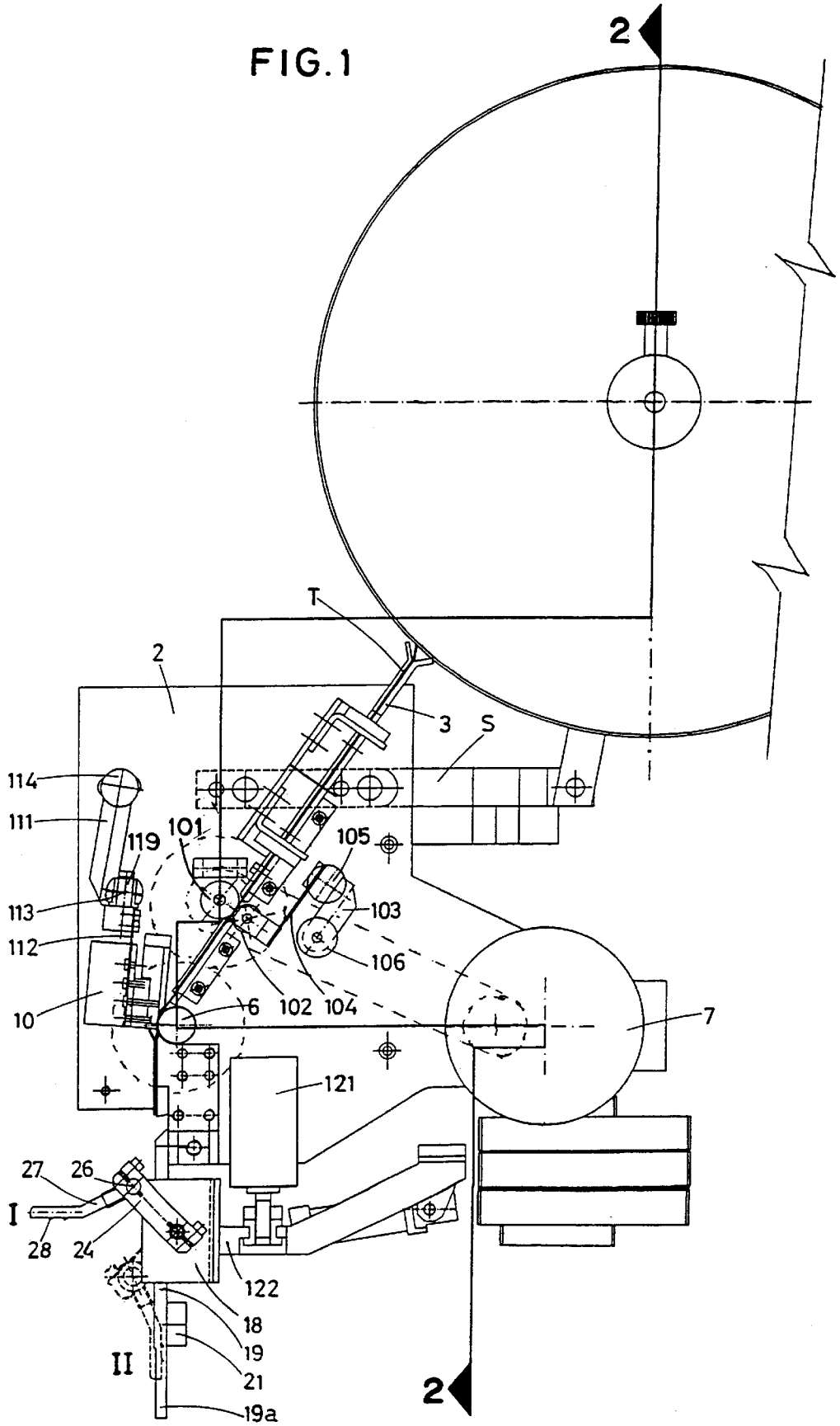
FIG. 1 shows a side elevation view of the machine with the receptacle for the bobbin of the label strip partially cut away, in which some parts are suppressed to be able to assess the course of the label strip (T) from the bobbin which houses the roll of said strip to the zone of cutting and separation of each label.
Figure 2:
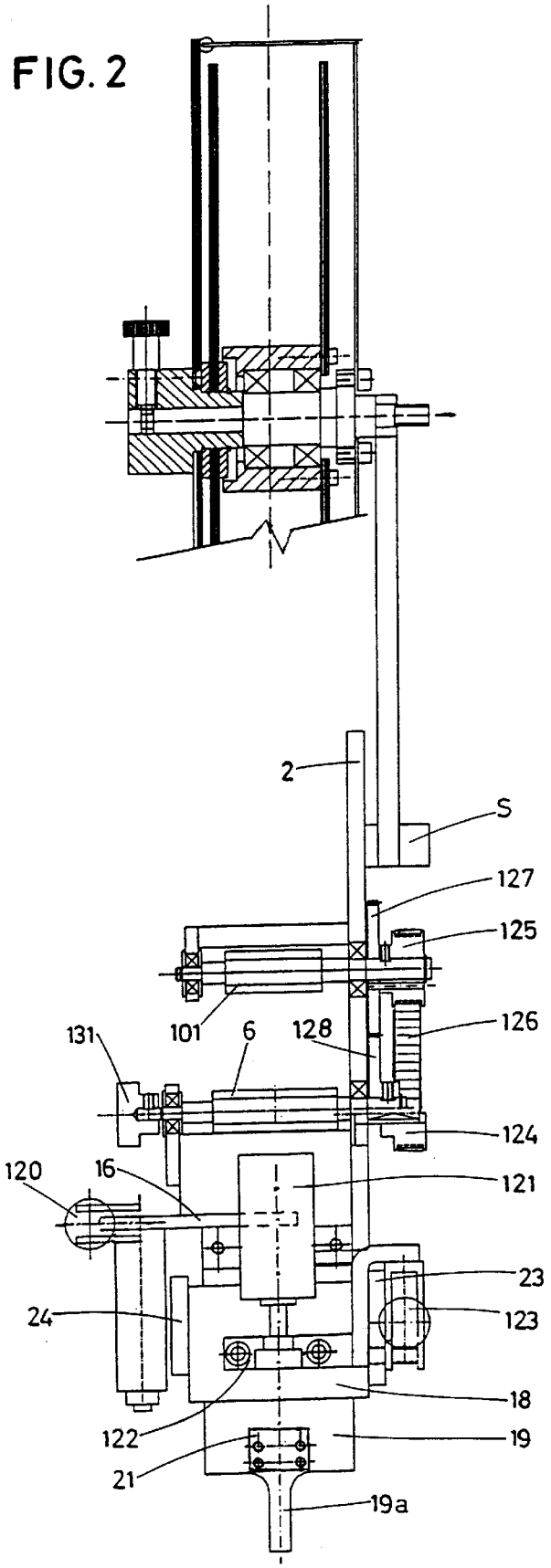
FIG. 2 concerns a cross section along 2—2 of FIG. 1 with the receptacle for the bobbin of the strip of labels partially cut away, in which is suppressed the guiding of the label strip, the printer head and its support and the detail of the terracing of the supporting plate of the labels and of its appendage, to facilitate the examination of this section of the machine.

In the drawings there is indicated with the same numeric references the parts or elements of the labelling machine already described and drawn in the U.S. Pat. No. 5,294,283 and there are indicated with new numeric references the parts or elements which are modified, preceded by the decimal point.

There is given as already reproduced the description of the parts of the automatic labelling machine indicated with the numeric references of units and of tenths, corresponding to the description and drawings of the U.S. Pat. No. 5,294, 283

The automatic labelling machine for packers in mesh bags or the like, in accordance with the improvements which are the object of the invention (FIGS. 1 and 3) have a second roller (101) with its corresponding counter roller (102), both having their non-slip surface, obtained for example with a covering of rubber or the like, and being arranged transversely with respect to the means of guiding (3) the label strip (T), the latter being pulled between the roller (101) and the counter roller (102) conjointly with the roller (6). The labelling machine has a support (S) for its attachment to the machine to which it is applied, normally a bagger (FIGS. 1 through 4).

Figure 3:
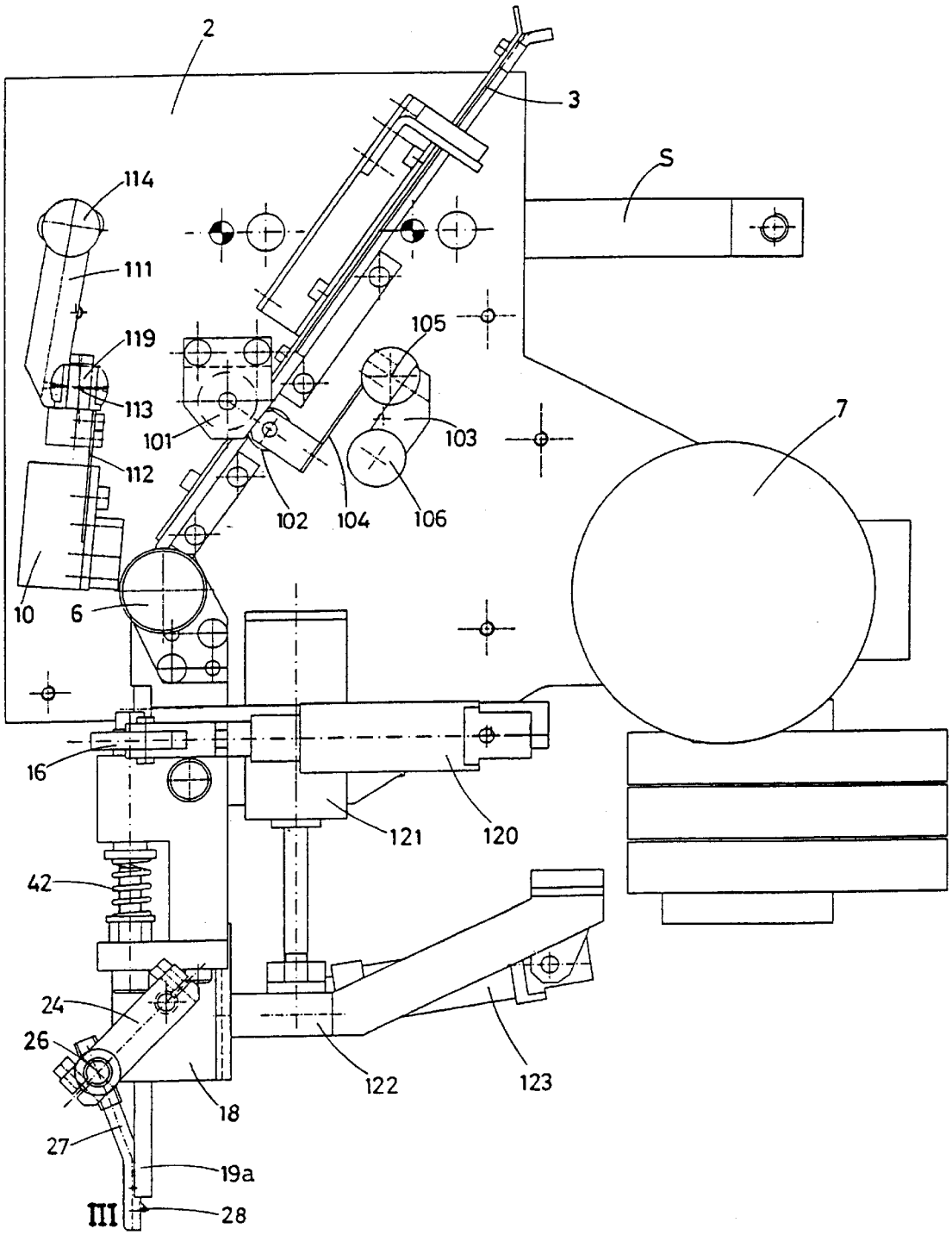
FIG. 3 concerns a side elevation view of the machine of greater size than in FIG. 1, in which there is suppressed the receptacle for the housing and guiding of the bobbin of the label strip.

The support (103) of the counter roller (102) has an elastic strap (104) at the free end of which is fixed the support of the counter roller (102) and which is able to turn the support (103) through the shaft (105) and said support has on its other free end a knob (106) to be able to activate manually in turning said support—to the left in FIGS. 1 and 3—and so be able to separate the counter roller (102) with respect to the label strip and its roller (101). The operative position of the counter roller (102), applied against the roller (101) with intercalation of the label strip, is keyed by the penetration of a short rod fixed on the knob and pressed outward by a spring, in an orifice (107) which the flange has (108) and which can turn with respect to the shaft (105), fixing in turn into position the flange by a bolt or the like countersunk into the orifice (109) of the same and which is applied against the frame (2). To be able to regulate said operating position there is an oblong orifice (110) in the frame (2).

The printer head (10) of high definition is mounted, in the same way as the counter roller (102), in the support (111) with the elastic strap (112), the turning shaft (113), the knob (114) with its corresponding rod and spring for its keying into the orifice (115) of the flange (116) with its spiral orifice (117) for the fixing of its position and the regulation of the operating position of the printer head (10) and the oblong orifice (118) in the frame (2) to permit said regulation. And the only difference between the mounting of the printer head (10) with respect to the mounting of the counter roller (102) is comprised in that in the first the strap is joined to a short bar (119) suitably adjusted in an orifice of the support (111) which permits oscillation of said head with respect to its longitudinal axis, for a better adaptation of the same against the upper surface of the labels intercalated between the head (10) and the roller (6).

Putting the counter roller in operating position (102) and the printer head (10), the displacement on the part of the user of the knobs (106) and (114) against the elastic action of its shown spring (not represented) raises the rods joined to said knobs and separates them from the corresponding orifice (107) and (115), making possible a turn in the counterclockwise direction on the support (103) and clockwise on the support (111) according to FIGS. 1 and 3, separating to the extent desired the counter roller and the head with respect to the label strip, to leave free these zones of the machine and perform operations of maintenance, tests, adjustments, and other operations thereon.

The moving knife (16) of the cutting means for separating each label from the strip is activated by some independent means, comprised in this example by a pneumatic cylinder (120) (FIGS. 2, 3, and 4) of double action and whose piston rod is articulated to the moving knife.

The displacement of the cart (18) is carried out by some independent means of action which in this example are comprised by a pneumatic cylinder (121) (FIGS. 1, 2, 3, and 4) of double action and which is linked with the support (122) which is in turn joined to the cart (18).

The turn of the finger (27) with the claws (28) is activated by some independent means which in this example are comprised of a pneumatic cylinder (123) (FIGS. 2 and 4) of double action and whose piston rod is articulated to the connecting rod (23) in turn joined rigidly to the connecting rod (24) (FIGS. 1, 2, and 3) by the tie rod (26) (FIGS. 1, 3, and 4) in which the finger is fixed (27). The pair of connecting rods (23) and (24) are articulated to the cart (18) by the transverse shaft (22) and which runs through the cart, it being possible to replace said shaft by two piston rods fixed to each side of the cart and aligned between themselves.

The independent means of activation (120), (121), and (123) may be any other conventional ones to obtain the alternating or back and forth displacement of the moving knife (16) of the cutting means, of the displacement of the cart (18), and the turning of the finger (27) with claws (28).

Figure 4:
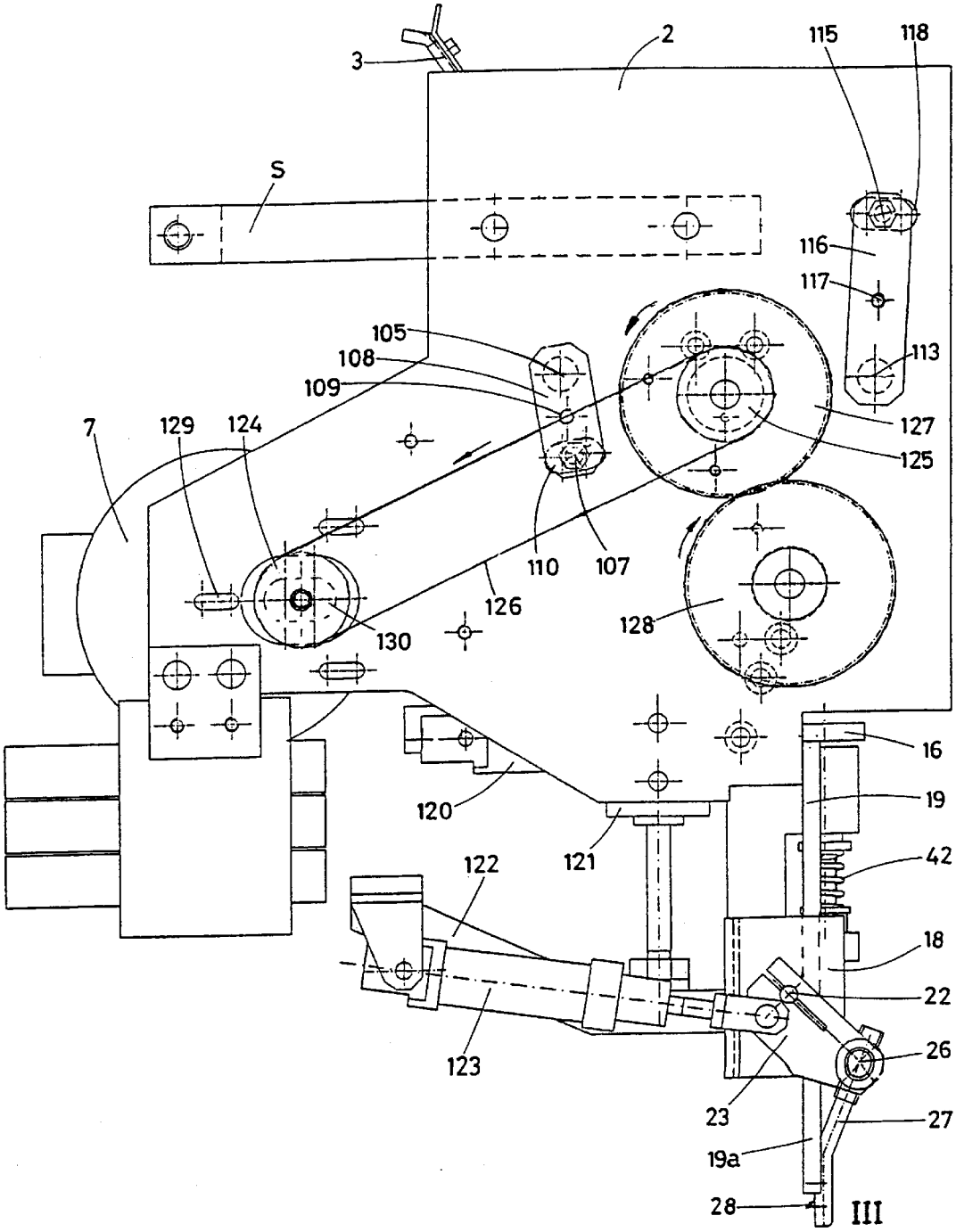
FIG. 4 concerns the view of the machine according to FIG. 3 turned 180 degrees.

The motor reducer (7) has a pulley (124) which is linked to another pulley (125) joined to the roller (101) through a toothed chain (126) (FIGS. 2 and 4 and outlined in FIG. 1); and the roller (101) has joined to it a toothed wheel (127) which meshes with another toothed wheel (128) joined to the roller (6) so that the turning of the pulley (124) of the motor reducer causes the turning of the roller (101) in the direction of advance of the strip of labels and the turning of the toothed wheel (127) causes the turning in the opposite direction of the toothed wheel (128) and as a result of that, the turning of the roller (6) in the direction of advance of the label strip downwardly. In FIG. 4 are represented the arrows indicating the described turning directions.

To regulate the tension of the toothed chain (126) the motor reducer is mounted on the frame (2) with both means of attachment, such as bolts with nuts which traverse the swivel orifices (129) (numbering three in FIG. 4) and the shaft of the motor reducer traverses another swivel orifice (130) to permit said regulation.

The roller (6) has joined to it a knob (131) (FIG. 2) for its manual activation, which will cause the turning of said roller and the turning of the roller (101) through the pair of toothed wheels (128) and (127) to perform tests and adjustments on the labelling machine.

The means of transmission between the motor reducer (7) and the roller (101) may be comprised of other conventional [components] other than the toothed chain (126) described. Moreover, the electric motor which is a part of the motor reducer (7) may have a brake, for example electronic by inversion or other conventional [one], for the cyclic stopping of the same during the operations of the labelling machine.

Figure 5:
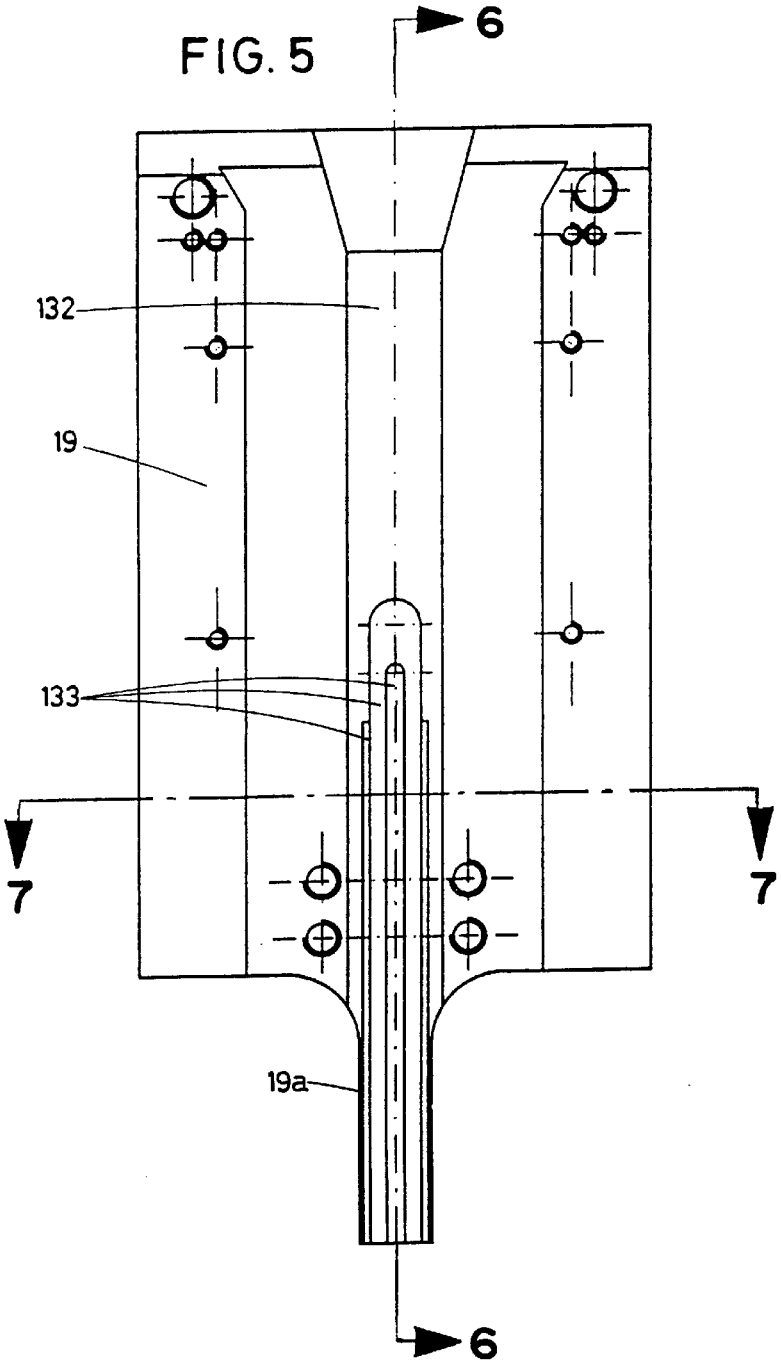
FIG. 5 represents in greater size, some details of the supporting plate of the corresponding label.
Figure 6:
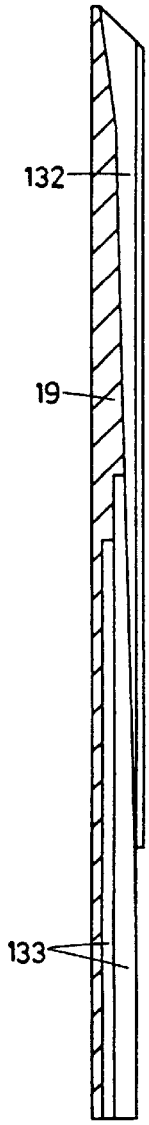
FIGS. 6 and 7 concern, respectively, both sections along 6—6 and along 7—7 of the supporting plate according to FIG. 5.
Figure 7:
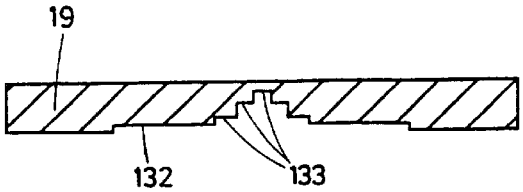

The supporting plate (19) of the labels has a central longitudinal channel (132) (FIGS. 5, 6, and 7) and a terraced interior (133) which extend in the appendage (19*a*) as represented in said FIGS. 5 through 7. This channel and terracing favor the subjection of the label on the part of the claws (28) of the finger (27) at the same time as a certain curve is produced in the label, facilitating the correct delivery of the same to the packing machine and favor the application of the means of subjecting the label to the corresponding bag or the like.

The control and the coordination of the different movements of the labelling machine can be carried out by a computer with its corresponding program or programs, connected to the different organs and means of the machine and with control means for the user.

In the labelling machine equipped with the improvements of the invention there has been eliminated, with respect to the U.S. Pat. No. 5,294,283, the projecting ends of the shaft which traverses the two sides of the cart, which have on one end a projection and whose other end is equipped with a cam, the articulation of the means of activating the cart with the tie rod in which is fixed the finger with claws and the retaining lever.

The operation of the labelling machine in question is, along general lines, the following: starting with the phase in which the strip of labels is already placed and arrives at the printer head (10), being supported on the roller (6) and having already carried out the printing upon the label, the motor reducer (7) turns in the direction indicated by the arrows of FIG. 4 the rollers (101) and (6) until the first label of the series of them which is to be printed is subjected by the finger (27) which has turned from the raised position (I) in which it was (FIG. 1) to the lowered position (II) indicated in outlines in FIG. 1, by the activation of the pneumatic cylinder (123) at which time is activated the pneumatic cylinder (120) which displaces the moving knife (16) to perform the cutting which separates the label from the rest of the strip of labels and then there is activated the pneumatic cylinder (121) which moves down to the cart and by it to the label subjected by the finger (27) with its claws (28) applied against the label or its appendage if there is one, introducing its center part into the channel (132) and in the terracing (133) of the supporting plate (19) and of its appendage (19*a*) (position III of maximum descent of the finger (27) represented in FIGS. 3 and 4) until the delivery of said label to the packing machine for the attachment of said label, for example with a staple, to the corresponding bag or the like conformed and filled with the desired product in said packing machine.

The cited pneumatic cylinders will move at the corresponding time the moving knife to its open or idle position, the finger to its open or separated position (I) of the support plate (19) and the cart (18) to its upper position shown in FIG. 1. The cycle repeats for each label.

What is claimed is:

1. In an automatic labeling machine for containers in the form of mesh bags, wherein said machine comprises means for guiding a continuous strip of labels fed from a roller;

means for cutting so as to separate a label from said strip of labels;

means for activating the strip of labels with a roller having a non-slip surface, and which in transverse with respect to the said strip, and in which the strip of labels is guided and supported, as well as pulled by motorized means;

said machine having a printer head for application of print to a side of a said label facing the printer head, and with the other side thereof supported by roller means;

means to separate the printer head from the strip of labels, including a rockeR displacement cart with finger and claw means to pull a cut label from said strip;

said improvement being characterized by a second roller and a corresponding counter roller, each having a non-slip surface, and said rollers being disposed upstream with respect to another roller facing said printer head and disposed parallel thereto; and by said strip of labels being pulled between said second roller and said counter roller; with independent activation means for said cutting means, and the displacement of the cart and said finger and claw means, and with said printer head and counter roller being mounted on a support having manual activation means for separating said printer head and counter roller from said strip of labels, with said rollers linked mechanically for turning and with one roller thereof being driven via a motor and associated transmission means.

* * * * *